US006394884B1

(12) United States Patent
Wuensch

(10) Patent No.: US 6,394,884 B1
(45) Date of Patent: May 28, 2002

(54) MOTOR-DRIVEN HAND GRINDER

(75) Inventor: Steffen Wuensch, Holzgerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 19 days.

(21) Appl. No.: 09/694,862

(22) Filed: Oct. 24, 2000

(30) Foreign Application Priority Data

Oct. 29, 1999 (DE) ..... 199 52 108

(51) Int. Cl.[7] ..... B24B 23/00
(52) U.S. Cl. ..... 451/357; 451/354; 451/358
(58) Field of Search ..... 451/354, 356–359, 451/524, 557

(56) References Cited

U.S. PATENT DOCUMENTS

| | | | | |
|---|---|---|---|---|
| 4,918,868 A | | 4/1990 | Barth et al. | |
| 5,453,040 A | * | 9/1995 | Schaal et al. | 451/344 |
| 5,458,533 A | | 10/1995 | Barth et al. | |
| 5,496,207 A | * | 3/1996 | Hornung et al. | 451/294 |
| 5,580,302 A | * | 12/1996 | Howard et al. | 451/357 |
| 5,595,531 A | * | 1/1997 | Niemela et al. | 451/357 |
| 5,772,498 A | * | 6/1998 | Neubert et al. | 451/357 |
| 5,807,169 A | * | 9/1998 | Martin et al. | 451/294 |
| 5,830,047 A | * | 11/1998 | McCracken | 15/143.1 |
| 5,888,128 A | * | 3/1999 | Lamprecht et al. | 451/357 |
| 5,947,804 A | * | 9/1999 | Fukinuki et al. | 451/342 |

FOREIGN PATENT DOCUMENTS

| | | |
|---|---|---|
| EP | 0 254 850 A3 | 2/1988 |
| EP | 0 573 916 A1 | 12/1993 |
| EP | 1 027 958 A2 | 8/2000 |
| WO | 88/04218 | 6/1988 |

* cited by examiner

*Primary Examiner*—Joseph J. Hail, III
*Assistant Examiner*—Anthony Ojini
(74) *Attorney, Agent, or Firm*—Michael J. Striker

(57) ABSTRACT

A motor-driven hand grinder formed as an eccentric disk grinder has a machine housing, a working spindle accommodated in the machine housing, a grinding disk unit which is driven to perform an eccentric movement and is rotatable, a ring-shaped first rolling surface rotatable together with the grinding disk unit about an eccentric axis, a ring-shaped second rolling surface having a central axis coaxial with a central axis of the working spindle and arranged so that the first rolling surface rolls on the second rolling surface, the second rolling surface being supported rotatably about its central axis, and a braking device associated with the second rolling surface for interrupting and releasing a rotation of the second rolling surface around its central axis.

11 Claims, 3 Drawing Sheets

MOTOR-DRIVEN HAND GRINDER

BACKGROUND OF THE INVENTION

The present invention relates to a motor-driven hand grinder, in particular an eccentric disk grinder.

Hand grinders of this type are known in the art. One of such hand grinders is disclosed for example in the European patent document EP 0 254 850 82. In this hand grinder the first rolling surface is formed as an outer toothed ring which rotates with the driven grinding disk around its axis, and a second rolling surface formed by an inner toothed ring on an outer tooth rim which is non rotatably held on the machine housing and is displaceable axially by an outer actuating device between an inoperative position and an operative position cooperating with the first rolling surface. In the inoperative position the second rolling surface is disengaged from the first rolling surface. In the operative position, to the contrary the second rolling surface can rotate substantially in the same geometrical plane as in the first rolling surface so that the first rolling surface during rotation of the grinding disk can roll on the second rolling surface, so that the eccentric movement of the grinding disk is superposed with a rotary movement around its eccentric axis. This leads to the situation that if the second rolling surface is located in the operational position, an increased workpiece wear occurs. Also, in the hand grinder there is the disadvantage that the conversion between the idle running and the positive drive is not possible during the operation of the hand grinder. During the axail relative displacement, damages can occur to the teeth of both rolling surfaces. It is also of disadvantage that the grinder has a relatively great structural height due to the arrangement of the rolling surfaces.

SUMMARY OF THE INVENTION

Accordingly, it is an object of present invention to provide a motor-driven hand grinder, in particular an eccentric disk grinder which avoids the disadvantages of the prior art.

In keeping with these objects and with others which will become apparent hereinafter, one feature of present invention resides, briefly stated, in a motor-driven hand grinder, in which the second rolling surface is supported rotatably about its central axis, and a braking device is associated with the second associated surface, for interrupting or releasing a rotation of the second rolling surface around its central axis.

When the hand grinder is designed in accordance with the present invention, it has the advantage that a switching between free running and positive driving during the operation of the hand grinder can be performed without the danger of a damage and a reduced structural height with lower operational expenses is achieved.

In accordance with a preferable embodiment of the present invention, the actuating device of the braking device has a manually-operated eccentric lever which actuates the braking member and is provided with an eccentric cooperating with the braking member.

The eccentric lever can be supported turnably in the machine housing and can have a pin formed as an eccentric. It engages in an opening, for example in a loop, at the end of the braking member, in particular a braking band which embraces the outer peripheral surface of the outer toothed rim.

In a further advantageous embodiment of the invention, the eccentric lever has a handle located outside of the machine housing for turning actuation. Preferably the eccentric lever is designed so that a tensioning of the braking band is performed by turning around a peripheral angle of substantially 180°. The handle of the eccentric lever can be turned easily between two positions over of a peripheral angle of 180°, and thereby a conversion between the positive driving and the idle running can be performed during the operation of the hand grinder.

In accordance with a further embodiment of the present invention, the outer toothed ring is a part, in particular one-piece part, of the grinder disk unit, for example a one-piece component of the grinding plate on which the outer toothed ring is injection molded. This is especially simple and cost favorable and additionally contributes to the reduction of the structural heights.

In accordance with a further preferable embodiment, the inner toothed ring of the outer toothed rim has a greater number of teeth than the outer tooth ring. The tooth number difference can amount for example to two. It is thereby provided that with the adjustment the positive driving of the grinding plate is performed with a predetermined rotary speed. When for example the oscillation number amounts to 10,000, then the tooth number difference is two.

In accordance with a further preferable embodiment, the grinding disk unit has a sleeve which is coupled with the working spindle, in particular in a non-rotatable manner, and provided for example at its end side with an eccentric pin. The grinding disk unit also has a grinding disk which is held on the eccentric pin by a bearing and is connected with an eccentric pin, for example by a screw.

It is further advantageous when the outer toothed rim has a bearing ring located along the central axis at an axial distance from the inner toothed ring and is rotatably supported with the bearing ring by a bearing relative to the machine housing, in particular with respect to the sleeve which is coaxial to the axis of the working spindle. The bearing can be for example pressed on the sleeve, and the outer toothed ring can be pressed with its bearing ring on the outer ring of the bearing.

In accordance with a further advantageous embodiment, an impeller wheel of an inner dust aspiration is mounted on the sleeve. Alternatively, the impeller wheel can also sit directly non rotatably on the working spindle and can have a sleeve which is eccentric relative to the spindle axis. A cylindrical sleeve for end-side holding of the grinding disk can be rotatably supported in the sleeve by a bearing.

In accordance with a further preferable embodiment, the sleeve with the end-side eccentric pin can be formed as a sintered part and therefore produced in an especially cost-favorable manner. It can be advantageous when the outer toothed rim is formed of a light metal or zinc pressure cast, so as to also provide a cost-favorable design.

In a further advantageous embodiment of the invention, the grinding disk is formed with one-piece outer tooth ring which forms the first rolling surface and is composed of a one-piece synthetic plastic injection molded component. Thereby a further cost reduction and simplification is obtained.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
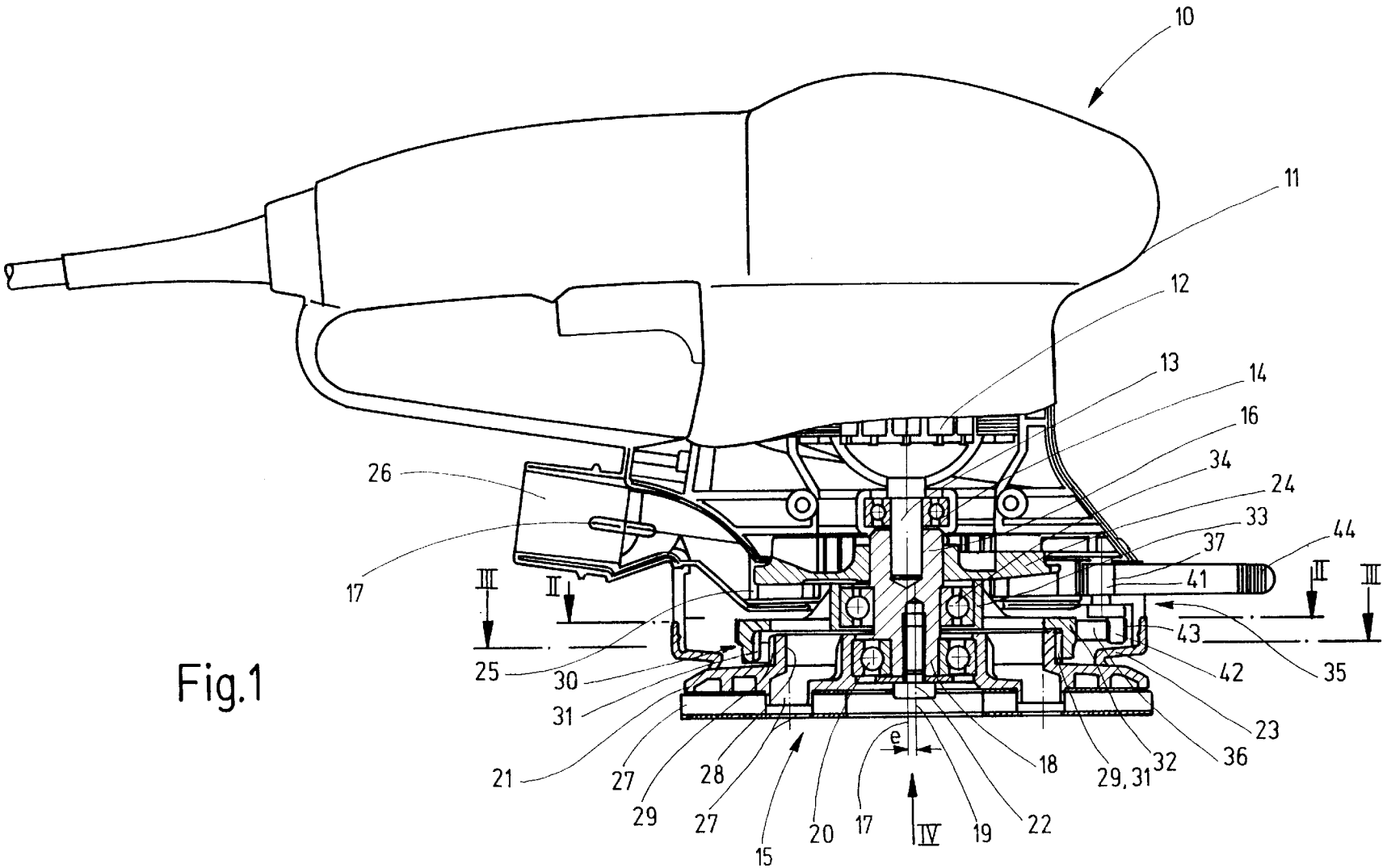
FIG. 1 is a view showing a schematic section of a hand grinder in accordance with the present invention.

A motor-driven hand grinder 10 is shown in FIG. 1 and formed as an eccentric disk grinder. The hand grinder 10 has a machine housing which is identified as a whole with reference numeral 11 and accommodates an electric drive motor 12 with a working spindle 13. The working spindle is supported by a bearing 14, for example formed as a ball bearing, in a machine housing 11. A grinding disk unit identified as a whole with reference numeral 15 is non rotatably seated on the working spindle 13. It is driven by the working spindle 13 to perform an eccentric movement and is rotatable. The grinding disk unit 15 has a sleeve 16 which is non rotatably and axially connected with the working spindle 13. The sleeve 16 extends coaxially with the axis 17 of the working spindle 13 and has an eccentric pin 18 which is provided for example at a lower end of FIG. 1 and which has an eccentric axis 19 with an eccentricity e to the axis 17 and parallel to it. A grinding disk 21 is rotatably supported on the eccentric pin 18 by a bearing 20, for example a ball bearing. The grinding disk 21 is connected non rotatably and axially non displaceably with the sleeve 16 and the eccentric pin 19 by a screw 20 which is coaxial to the eccentric axis 19 and is screwed in the eccentric pin 18.

A sealing unit 23 is located between the machine housing 11 and the upper side of the grinding disk 21 in FIG. 1 to seal an intermediate space. The hand grinder 10 is provided with an inner dust aspiration which includes an impeller wheel 24 non-rotatably held on the sleeve 16. The impeller 24 is located in a chamber 25 which is connected to a dust aspiration passage 26. The grinding disk 21 is provided with passages and/or through holes 27 for the inner dust aspiration.

The sand grinder 10 has a ring-shaped first rolling surface 28 which rotates together with the grinding disk unit 15 around the eccentric axis 19. It is formed here as an outer toothed ring 29. This outer tooth ring 29 can be formed in a not shown embodiment as an independent component, for example tooth gear which is connected non rotatably with the sleeve 16. In the shown embodiment the outer tooth ring 29 in a simple manner is a part, in particular one-piece part of the grinding disk unit 15 and in particular grinding disk 21. In this one-piece design it is formed in advantageous manner as a synthetic plastic injection molded part.

A ring shaped second rolling surface 30 is associated with the first rolling surface 28, in particular the outer tooth ring 29. It surrounds the first rolling surface 28 and its central axis extends coaxially to the central axis 17 of the working spindle 13. The first rolling surface 28 rolls on the second rolling surface 30 when the drive motor 12 is turned on. The second rolling surface 30 is preferably formed as an inner toothed ring 31 of an outer toothed rim 32. The second rolling surface 30, in particular the outer toothed rim 32 which carries it, is supported rotatably about the axis 17. In the shown embodiment the outer toothed rim 32 has a bearing ring 33 of a smaller diameter arranged along the axis 17 at an axial distance from the inner toothed ring 31. The outer toothed rim 32 is rotatably supported through it by a bearing 34, for example a ball bearing, on the sleeve 16. The inner ring of the bearing 34 is non rotatably connected with the sleeve 16, while the outer ring of the bearing 34 is non-rotatably connected with the bearing ring 13 and thereby the outer ring 32.

A braking device identified as a whole with reference numeral 35 is associated with the second rolling surface 30. It selectably interrupts or releases a rotation of the second rolling surface 30 around its central axis, in particular the axis 17. Therefore an arrangment is provided, in which the rotatability of the second rolling surface 30, in particular the outer tooth ring 32 is interrupted or released by the braking device 35 during the machine operation. The outer toothed rim 32 is formed as a one-piece component and advantageously composed of a light metal pressure cast part. The sleeve 16 with an end-side eccentric pin 18 is formed advantageously of a sintered part.

In the shown embodiment the impeller wheel 24 is non rotatably arranged on the sleeve 16 as a part of the inner dust aspiration. In accordance with another, not shown embodiment, instead the impeller wheel can be formed on an impeller sleeve which is non rotatably arranged on the working spindle 13 and has an inner sleeve which is eccentric to the axis 17. In the inner sleeve, by means of a bearing coaxial to the eccentric axis 19, a cylindrical sleeve which is similar to the sleeve 16 is held rotatably and axially immovably. The grinding disk 21 is releasably mounted on its end side by the screw 22.

The braking device 35 has a braking member 36 which brakingly acts on the second rolling surface 30, and an actuating device 37 for actuation of the braking member 36. The braking member 36 is provided with a braking surface 38, with which the braking member 36 can flatly engage an associated surface 39 of the second rolling surface 30 for rotary blocking of the second rolling surface 30. The surface 39 is formed in particular as an outer surface of the outer toothed rim 32. The second rolling surface 30 extends outwardly and surrounds the first rolling surface 28. The both surfaces extend substantially inside of a common plane which is diametrical to the axis 17 of the working spindle 13. The surface 39 of the second roller surface 30 which is designed as an outer surface is composed of the outer peripheral surface 40 of the outer tooth rim 32.

The braking member 36 is composed of such a braking part which can abut with its braking surface 38 formed on the associated surface 39 of the second rolling surface 30, against the peripheral surface 40 of the outer toothed rim 32 to block rotation. In particularly simple embodiment, the braking member 36 is composed of a braking band which surrounds the outer peripheral surface 40 of the outer tooth rim 32, and can be tensioned for rotary blocking against the outer peripheral surface 40.

The actuating device 36 has an eccentric lever which is provided with a centric part 41 turnably supported in a machine housing 11 and an eccentric pin 42, one end of the braking member 36 formed as the braking band engages in an opening 43, for example a loop. A handle 44 for turning actuation located outside of the machine housing 11 engages the centric part 41. The actuating device 47 in form of the above mentioned eccentric lever is designed so that a tensioning of the braking member 36 formed as a braking band is performed by turning of the centric part 41 over a peripheral angle of substantially 180°. The clamped position and thereby the condition of the outer tooth rim 32 blocked against rotation is shown in FIG. 3. When the handle 44 is turned in a counter clockwise direction over approximately 180° to the position shown in FIG. 2, the braking member 36 in form of the braking band is released, so that the outer toothed rim 32 is not blocked and therefore its rotation about the axis 17 which is its central axis is released.

In another not shown embodiment, the actuating device 37 has magnets, for example a controllable electromagnet which acts on the braking member 36 formed as a braking band and tensions the braking band.

A further feature of the inventive hand grinder 10 is that the inner toothed ring 31 of the outer toothed rim 32 has a greater tooth number than the outer toothed ring 29. The tooth number difference can amount for example to 2. This leads to the situation that with the braked outer toothed rim 32, the outer toothed ring 29 which rolls over the inner toothed ring 31 per 180° eccentric movement rotates by one tooth farther and thereby with the grinding disk 21 provided with the outer toothed ring 29 a rotary speed is obtained during rolling. The rotary speed of the grinding disk 21, at a given rotation number 10,000 amounts to for example 417 revolutions per minute.

When the braking device 35 is brought to the braking position shown in FIG. 3 and the drive motor 12 is turned on, then the working spindle 13 and the sleeve 16 together with the impeller wheel 24 and some not shown compensation methods is driven in rotation, for example 10,000 revolutions per minute. In the shown embodiment the drive of the working spindle 13 is obtained directly on the sleeve 16. In another not shown embodiment, instead a transmission can be arranged therebetween. Because of the drive movement, the grinding disk 21 is driven so that additionally to the eccentric movement, a rotation around the eccentric axis 19 is provided, and an eccentric rotary movement of the grinding disk 21 is therefore obtained. Because of the activated braking device 35, the outer toothed rim 32 is prevented from rotation, so that the outer toothed ring 29 during rotation on the inner toothed ring 31 can roll. In this stage a positive driving of the grinding disk 21 is performed additionally around the eccentric axis 19.

Figure 2:
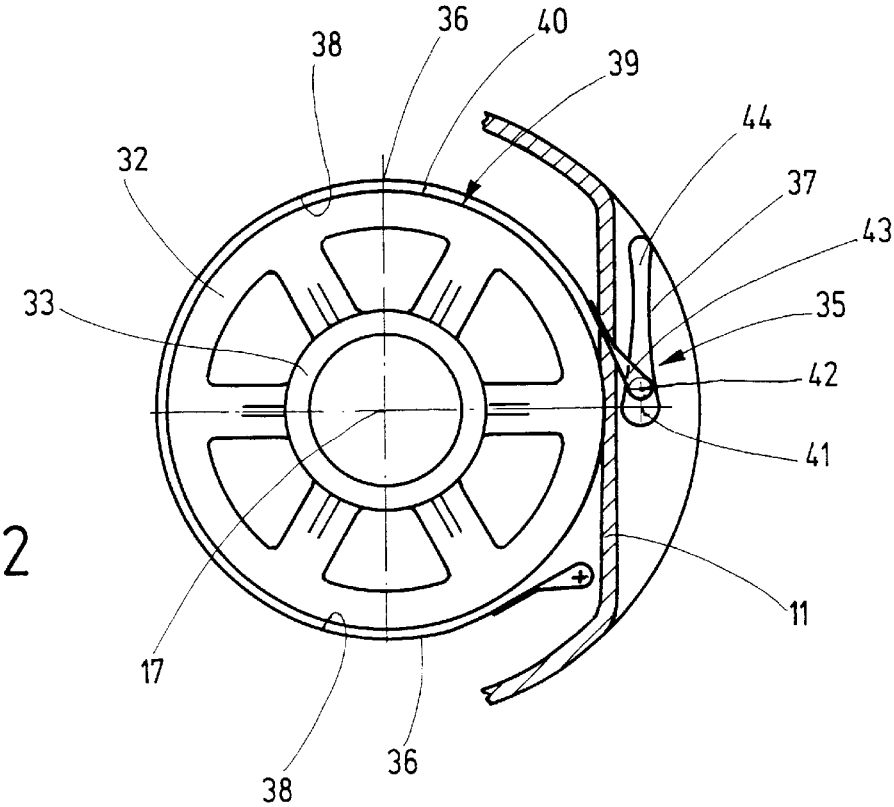
FIG. 2 is a schematic plan view of parts of a braking device of the hand grinder in accordance with the present invention in the plane II—II in FIG. 1.
Figure 3:
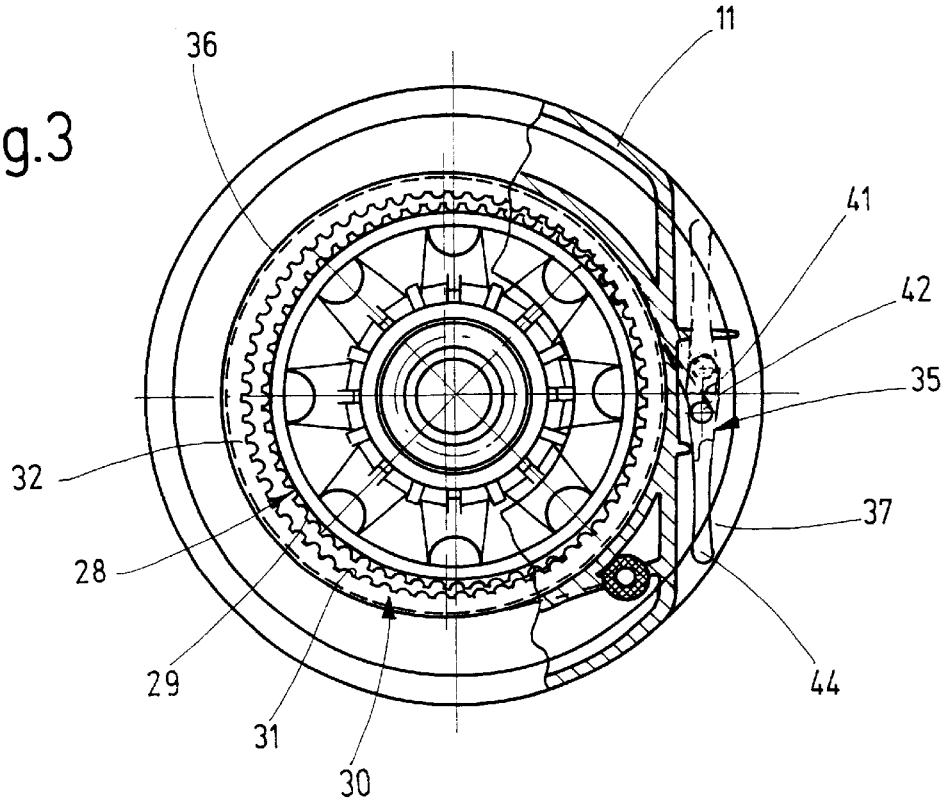
FIG. 3 is a view showing a schematic partial section taken along the line III—III in FIG. 1.
Figure 4:
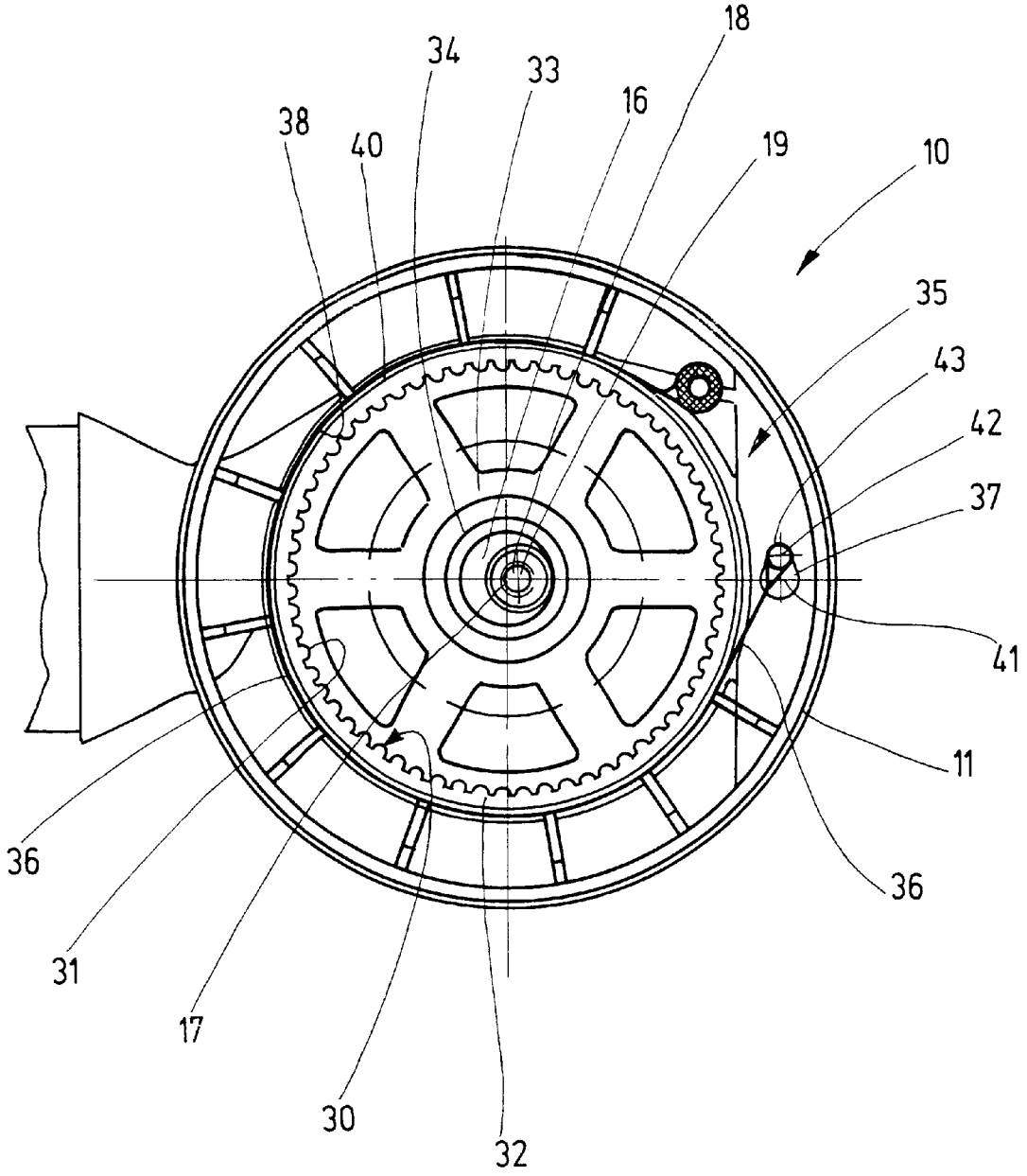
FIG. 4 is a schematic bottom view of parts of the inventive hand grinder in direction of the arrow IV in FIG. 1, without a grinding disk.

Now during the operation of the hand grinder 10 by means of the actuation device 37 the braking member 36 is transferred to the not braking condition shown in FIG. 2, and the outer toothed rim 32 is freely rotatable around the axis 17 because of the support by means of the bearing 34 of the sleeve 16. The outer toothed rim 32 can now co-rotate due to the friction in the bearing 34. Depending on the friction condition, a relative movement of the outer toothed ring 32 is performed in an opposite rotary direction to the grinding disk 21. The rotary speed of the grinding disk 21 is dependent on the loading of the substrate, or in other words dependent on how strong the hand grinder 10 with the grinding disk 21 and its releasably mounted grinding sheet, for example by a burdock connection, is pressed against the workpiece to be treated. The rotary speed of the grinding disk 21 can be also zero, depending on the certain conditions. In this stage the free running operation for the hand grinder 10 is provided.

During the operation of the turned-on hand grinder 10, it can be converted from this free running operation again to the positive driving by actuation of the braking device 13.

The above described hand grinder 10 is simple, compact and cost favorable. It allows, during the operation of the machine, a conversion and a continuous transition from the positive grinding to the free running by lever actuation or by another, not shown embodiment, through activation of a magnet. Since the outer toothed ring 29 is injection molded on a ring part of the grinder disk 21 as a single part, the advantage of reduced components and reduced structural height are provided. Moreover, in an advantageous manner the lower expenses are needed for the actuation of the rolling transmission composed of the outer toothed ring 29 and the inner toothed ring 31.

It will be understood that each of the elements described above, or two or more together, may also find a useful application in other types of constructions differing from the types described above.

While the invention has been illustrated and described as embodied in motor-drive hand grinder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A motor-driven hand grinder formed as an eccentric disk grinder, comprising a machine housing, a working spindle accommodated in said machine housing; a grinding disk unit which is driven to perform an eccentric movement and is rotatable; a ring-shaped first rolling surface rotatable together with said grinding disk unit about an eccentric axis; a ring-shaped second rolling surface having a central axis coaxial with a central axis of said working spindle and arranged so that said first rolling surface rolls on said second rolling surface, said second rolling surface being supported rotatably about its central axis; and a braking device associated with said second rolling surface for interrupting and releasing a rotation of said second rolling surface around its central axis.

2. A motor-driven hand grinder as defined in claim 1, wherein said braking device is formed so that the rotation of said second rolling surface is interruptable and releasable during a machine operation.

3. A motor-driven hand grinder as defined in claim 1, wherein said braking device has a braking member which brakingly acts on said second rolling surface, and an actuating device for actuating said braking member.

4. A motor-driven hand grinder as defined in claim 3, wherein said braking member has a braking surface with which said braking member is flatly engageable for blocking said second rolling surface with an associated surface of said second rolling surface, which is an outer surface of said second rolling surface.

5. A motor-driven hand grinder as defined in claim 3, wherein said second rolling surface formed as said outer toothed rim has an outer peripheral surface which cooperates with said braking surface of said braking member for blocking the rotation.

6. A motor-driven hand grinder as defined in claim 3, wherein said braking member of said braking device has an inner surface which is formed as a braking surface and abuts against an associated surface which is an outer peripheral surface of an outer toothed rim which forms said second rolling surface.

7. A motor-driven hand grinder as defined in claim 3, wherein said braking member is formed as a braking band which is tensionable against an outer peripheral surface of an outer toothed rim which forms said second rolling surface.

8. A motor-driven hand grinder as defined in claim 7, wherein said actuation device is formed as a controllable electromagnet which tensions said braking member formed as said braking band.

9. A motor-driven hand grinder as defined in claim 3, wherein said actuating device is formed as a hand-operated eccentric lever provided with an eccentric which acts on said braking member.

10. A motor-driven hand grinder as defined in claim 1, wherein said second rolling surface extends outwardly and surrounds said first rolling surface, said both rolling surfaces extending substantially inside a common plane which is diametrical to said axis of said working spindle.

11. A motor-driven hand grinder as defined in claim 1, wherein said second rolling surface is formed as an inner toothed ring of an outer toothed rim, while said first rolling surface is formed as an outer toothed ring.

* * * * *